US007354686B2

(12) United States Patent
Toda et al.

(10) Patent No.: US 7,354,686 B2
(45) Date of Patent: Apr. 8, 2008

(54) ELECTROPHOTOGRAPHIC PHOTOCONDUCTOR AND PROCESS FOR MANUFACTURING THE SAME, AND IMAGE FORMING APPARATUS AND PROCESS CARTRIDGE CONTAINING THE SAME

(75) Inventors: Naohiro Toda, Kanagawa (JP); Tatsuya Niimi, Shizuoka (JP); Ryohichi Kitajima, Shizuoka (JP); Yoshiaki Kawasaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 226 days.

(21) Appl. No.: 10/804,067

(22) Filed: Mar. 19, 2004

(65) Prior Publication Data

US 2004/0234875 A1 Nov. 25, 2004

(30) Foreign Application Priority Data

Mar. 20, 2003 (JP) ..... 2003-079206

(51) Int. Cl.
*G03G 5/05* (2006.01)
*G03G 5/047* (2006.01)

(52) U.S. Cl. ..... 430/58.7; 430/59.5; 430/133; 430/60; 430/65; 399/159

(58) Field of Classification Search ..... 430/59.5, 430/59.4, 133, 58.05, 58.65, 59.1, 60, 58.7
See application file for complete search history.

(56) References Cited

U.S. PATENT DOCUMENTS

| | | | | |
|---|---|---|---|---|
| 4,806,443 | A * | 2/1989 | Yanus et al. | 430/56 |
| 5,567,559 | A * | 10/1996 | Yang et al. | 430/59.5 |
| 5,604,063 | A * | 2/1997 | Endo et al. | 430/59.6 |
| 5,853,935 | A | 12/1998 | Suzuki et al. | |
| 6,132,911 | A | 10/2000 | Niimi | |
| 6,218,533 | B1 | 4/2001 | Niimi | |
| 6,319,878 | B1 | 11/2001 | Ina et al. | |
| 6,326,112 | B1 | 12/2001 | Tamura et al. | |
| 6,516,169 | B2 | 2/2003 | Niimi et al. | |
| 6,521,387 | B2 | 2/2003 | Kawasaki | |
| 6,558,863 | B2 | 5/2003 | Rokutanzono et al. | |
| 6,562,531 | B2 | 5/2003 | Niimi | |
| 6,573,016 | B2 | 6/2003 | Kami et al. | |
| 6,576,388 | B2 | 6/2003 | Sakon et al. | |
| 6,623,899 | B2 * | 9/2003 | Takaya et al. | 430/65 |
| 6,641,964 | B2 | 11/2003 | Ikuno et al. | |
| 6,653,033 | B1 | 11/2003 | Kami et al. | |
| 6,677,091 | B2 | 1/2004 | Niimi | |
| 2002/0064721 | A1 * | 5/2002 | Ishii et al. | 430/69 |
| 2003/0002078 | A1 | 1/2003 | Toda et al. | |
| 2004/0053149 | A1 * | 3/2004 | Toda et al. | 430/59.5 |

FOREIGN PATENT DOCUMENTS

| | | |
|---|---|---|
| JP | 61-238060 | 10/1986 |
| JP | 63-077059 | 4/1988 |
| JP | 4-318557 | 11/1992 |
| JP | 5-43813 | 2/1993 |
| JP | 07-325406 | 12/1995 |
| JP | 2001-019871 | 1/2001 |
| JP | 2002-091043 | 3/2002 |
| JP | 2003-29429 | 1/2003 |

OTHER PUBLICATIONS

Diamond, Arthur S & David Weiss (eds.) Handbook of Imaging Materials. New York: Marcel-Dekker, Inc. (Nov. 2001) pp. 145-164.*
U.S. Appl. No. 11/367,786, filed Mar. 6, 2006, Ohta, et al.
U.S. Appl. No. 11/403,012, filed Apr. 13, 2006, Toda.
U.S. Appl. No. 11/364,325, filed Mar. 1, 2006, Niimi.
U.S. Appl. No. 11/332,545, filed Jan. 17, 2006, Tamoto, et al.
U.S. Appl. No. 10/606,750, filed Jun. 27, 2003, Toda, et al.
U.S. Appl. No. 11/304,711, filed Dec. 16, 2005, Kondo, et al.
U.S. Appl. No. 11/217,407, filed Sep. 2, 2005, Toda, et al.
U.S. Appl. No. 11/157,998, filed Jun. 22, 2005, Tamura, et al.
U.S. Appl. No. 11/007,784, filed Dec. 9, 2004, Kondo, et al.
U.S. Appl. No. 11/030,307, filed Jan. 7, 2005, Kami, et al.
U.S. Appl. No. 11/016,708, filed Dec. 21, 2004, Kitajima, et al.
U.S. Appl. No. 11/272,826, filed Nov. 15, 2005, Kawasaki, et al.
U.S. Appl. No. 11/219,886, filed Sep. 7, 2005, Niimi, et al.
U.S. Appl. No. 10/454,556, filed Jun. 5, 2003, Niimi, et al.
U.S. Appl. No. 10/315,935, filed Dec. 11, 2002, Kurimoto et al.
U.S. Appl. No. 10/384,662, filed Mar. 11, 2003, Sugino, et al.
U.S. Appl. No. 10/205,413, filed Jul. 26, 2002, Niimi et al.
U.S. Appl. No. 10/176,578, filed Jun. 24, 2002, Yagi, et al.
U.S. Appl. No. 10/318,109, filed Dec. 13, 2002, Sugiura, et al.
U.S. Appl. No. 10/135,548, filed May 1, 2002, Kami, et al.
U.S. Appl. No. 09/985,347, filed Nov. 2, 2001, Suzuki, et al.
U.S. Appl. No. 09/566,958, filed May 8, 2000, Niimi, et al.
U.S. Appl. No. 11/474,258, filed Jun. 26, 2006, Niimi.
U.S. Appl. No. 11/480,517, filed Jul. 5, 2006, Yanagawa, et al.
U.S. Appl. No. 11/611,179, filed Dec. 15, 2006, Niimi, et al.
U.S. Appl. No. 11/625,873, filed Jan. 23, 2007, Niimi.
U.S. Appl. No. 11/736,258, filed Apr. 17, 2007, Kawasaki, et al.
U.S. Appl. No. 11/685,441, filed Mar. 13, 2007, Yanagawa, et al.
U.S. Appl. No. 11/834,240, filed Aug. 6, 2007, Hirose, et al.

* cited by examiner

*Primary Examiner*—Christopher RoDee
(74) *Attorney, Agent, or Firm*—Oblon, Spivak, McClelland, Maier & Neustadt, P.C.

(57) ABSTRACT

An electrophotographic photoconductor includes an electroconductive substrate, a charge generation layer, and a charge transport layer formed by using a halogen-free solvent, arranged in this order, in which the charge generation layer contains a charge generation material having an average particle diameter smaller than a surface roughness of a plane where the electroconductive substrate is arranged, and a polyvinyl acetal resin having a ratio Mw/Mn of a weight-average molecular weight Mw to a number-average molecular weight Mn is 2.2 or more.

22 Claims, 5 Drawing Sheets

ELECTROPHOTOGRAPHIC PHOTOCONDUCTOR AND PROCESS FOR MANUFACTURING THE SAME, AND IMAGE FORMING APPARATUS AND PROCESS CARTRIDGE CONTAINING THE SAME

BACKGROUND OF THE INVENTION

1. Field of the Invention

The present invention relates to an electrophotographic photoconductor containing a charge generation layer and a charge transport layer sequentially arranged and manufacturing process thereof, and to an electrophotographic apparatus and a process cartridge for electrophotographic apparatus containing the electrophotographic photoconductor. More specifically, it relates to an electrophotographic photoconductor that shows less variation in sensitivity and excellent electrostatic properties even when a halogen-free coating solvent is used, and to an image forming apparatus and a process cartridge for image forming apparatus containing the electrophotographic photoconductor.

2. Description of the Related Art

Information processing systems using electrophotographic process have been dramatically developed. Among them, optical printers convert information into digital signals, produce records on information optically and thereby have remarkably improved print quality and reliability. In addition to printers, the digital recording technique is also applied to regular copiers, to yield "digital" copiers. Copiers using the digital recording technique in addition to conventional analogue copying techniques can have a variety of information processing functions and are expected to be increasingly used. In addition, with an increasing proliferation and improved properties of personal computers, digital color printers for output of color images and documents have rapidly advanced.

Electrophotographic photoconductors utilizing organic photoconductive materials exhibiting outstanding properties in terms of sensitivity, thermal stability and toxicity as compared with conventional inorganic materials as Se, CdS, and ZnO are now widely used in such image forming apparatus. As a photoconductive layer of an electrophotographic photoconductor using the organic photoconductive material, one comprising a charge generation layer and a charge transport layer arranged sequentially and thus having separated functions in the individual layers is generally used for its excellent sensitivity and durability.

A variety of charge generation materials such as azo pigments, polycyclic quinone pigments, trigonal selenium and phthalocyanine pigments have been developed for use in the charge generation layer. Among them, phthalocyanine pigments show high sensitivity with respect to light with long wavelengths of 600 nm to 800 nm and are very important and useful as photoconductive materials for electrophotographic printers and digital copiers using a light-emitting diode (LED) or a laser diode (LD) as a light source.

The charge transport layer mainly contains a charge transport material and a binder resin and is generally prepared by dissolving or dispersing these materials in a solvent to form a coating composition, and applying the coating composition. A halogen-containing solvent such as dichloromethane or chloroform is generally used as the solvent for satisfactory solubility or dispersibility and coating ability.

With an increasing environmental aware, a demand has been made to develop photoconductors using halogen-free solvents that affect the human body and environment less. However, a photoconductor prepared using a coating composition for charge transport layer using a halogen-free solvent shows decreased optical sensitivity in initial stages and/or after repetitive use, although it has increased electrostatic properties.

As a possible solution to prevent such a decreased sensitivity, Japanese Patent Application Laid-Open (JP-A) No. 04-318557 (page 3, left column, lines 5-33 in Japanese) and Journal of Imaging Science, vol. 35, No. 4, p. 235 (1991) each disclose a method for increasing the optical sensitivity by milling a phthalocyanine pigment to thereby reduce its particle diameter.

JP-A No. 2001-115054 discloses a titanyl phthalocyanine containing unchlorinated titanyl phthalocyanine and a chlorinated titanyl phthalocyanine in a specific amount, and a titanyl phthalocyanine having an average particle diameter of 1 μm or less (Claims 1 and 3; and page 3, right column, lines 10-20 in Japanese).

However, when these techniques are applied to a photoconductor using a halogen-free solvent in a coating composition for charge transport layer, the optical sensitivity significantly decreases in the initial stage and/or after repetitive use.

JP-A No. 10-326023 discloses the use of a dioxolane compound as a halogen-free organic solvent (Claims 1; and page 3, left column, lines 15-21 in Japanese). JP-A No. 2001-356506 discloses a coating composition for charge transport layer containing a cyclic ether solvent such as tetrahydrofuran and, in addition, a specific stabilizer such as antioxidant or ultraviolet absorber, since such a cyclic ether solvent generates a peroxide after leaving stand (Claim 1; and page 5, right column, lines 41-45 in Japanese).

However, these techniques insufficiently solve the above problems or invite decreased sensitivity due to the additives.

Demands have therefore been made on an electrophotographic photoconductor showing satisfactory optical sensitivity in the initial stage and even after repetitive use and having outstanding electrostatic properties even when a halogen-free solvent is used in a coating composition for charge transport layer, as well as an image forming apparatus using the electrophotographic photoconductor, and a process cartridge for the image forming apparatus.

Objects and Advantages

Accordingly, an object of the present invention is to provide an electrophotographic photoconductor showing satisfactory optical sensitivity in the initial stage and even after repetitive use, and having outstanding electrostatic properties even when a halogen-free solvent is used in a coating composition for charge transport layer, as well as a process for manufacturing the electrophotographic photoconductor, and a an image forming apparatus and a process cartridge containing the electrophotographic photoconductor.

SUMMARY OF THE INVENTION

After intensive investigations on the decreased sensitivity of an electrophotographic photoconductor upon the use of such a halogen-free solvent, the present inventors have accomplished the present invention.

Specifically, the present invention provides, in a first aspect, an electrophotographic photoconductor comprises an electroconductive substrate, a charge generation layer, and a charge transport layer formed by using a halogen-free solvent, arranged in this order. The charge generation layer comprises a charge generation material in the form of particles having an average particle diameter smaller than a surface roughness of a plane where the charge generation layer is arranged, and a polyvinyl acetal resin having a ratio Mw/Mn of a weight-average molecular weight Mw to a number-average molecular weight Mn is 2.2 or more.

The second aspect of the present invention is the electrophotographic photoconductor according to the first aspect, wherein the plane where the charge generation layer is arranged, is a surface of the electroconductive substrate.

The third aspect of the present invention is the electrophotographic photoconductor according to the first aspect, further comprising an interlayer disposed between the electroconductive substrate and the charge generation layer, wherein the plane where the charge generation layer is arranged, is a surface of the interlayer.

The fourth aspect of the present invention is the electrophotographic photoconductor according to the first aspect, wherein the average particle diameter of the charge generation material is 0.3 μm or less and is two-thirds or less of the surface roughness of a plane where the charge generation layer is arranged, and wherein the polyvinyl acetal resin has a number-average molecular weight Mn in terms of polystyrene of 100,000 or more.

The fifth aspect of the present invention is the electrophotographic photoconductor according to the first aspect, wherein the charge generation material is a titanyl phthalocyanine.

The sixth aspect of the present invention is the electrophotographic photoconductor according to the fifth aspect, wherein the titanyl phthalocyanine shows a maximum diffraction peak at 27.2±0.2° in terms of Bragg 2θ angle to the CuK-α characteristic X-ray wavelength at 0.1542 nm.

The seventh aspect of the present invention is the electrophotographic photoconductor according to the sixth aspect, wherein the titanyl phthalocyanine shows a maximum diffraction peak at 27.2±0.2° and a peak as a lowest-angle peak at 7.3±0.2° and shows no peak in a range between 7.4° and 9.4° in terms of Bragg 2θ angle to the CuK-α characteristic X-ray wavelength at 0.1542 nm.

The eighth aspect of the present invention is the electrophotographic photoconductor according to the seventh aspect, wherein the titanyl phthalocyanine shows no peak at 26.3° in terms of Bragg 2θ angle to the CuK-α characteristic X-ray wavelength at 0.1542 nm.

The ninth aspect of the present invention is the electrophotographic photoconductor according to the fifth aspect, wherein the charge generation layer is formed by a process comprising the steps of: dispersing particles of the titanyl phtalocyanine so as to have an average particle diameter of 0.3 μm or less with a standard deviation of 0.2 μm or less, to yield a dispersion; filtering the dispersion through a filter having an effective pore size of 3 μm or less; and applying the filtered dispersion to form the charge generation layer.

The tenth aspect of the present invention is the electrophotographic photoconductor according to the fifth aspect, wherein the titanyl phthalocyanine is prepared by the process comprising the steps of: subjecting an amorphous titanyl phthalocyanine or low-crystallinity titanyl phthalocyanine to crystal transformation using an organic solvent in the presence of water, the amorphous titanyl phthalocyanine or low-crystallinity titanyl phthalocyanine showing a maximum diffraction peak (±0.2°) at least at 7.0° to 7.5° with a half width of 1° or more in terms of Bragg 2θ angle to the CuK-α characteristic X-ray wavelength at 0.1542 nm and having an average primary particle diameter of 0.1 μm or less; and fractionating and filtering the crystal-transformed titanyl phthalocyanine from the organic solvent before the transformed crystals of the titanyl phthalocyanine grow to have an average primary particle diameter more than 0.3 μm.

The eleventh aspect of the present invention is the electrophotographic photoconductor according to the first aspect, wherein the charge transport layer comprises polycarbonate having a triarylamine structure in at least one of principal chain and side chain thereof.

The twelfth aspect of the present invention is the electrophotographic photoconductor according to the first aspect, further comprising a surface protective layer on or above the charge transport layer.

The thirteenth aspect of the present invention is the electrophotographic photoconductor according to the twelfth aspect, wherein the surface protective layer comprises at least one of an inorganic pigment and a metal oxide each having a specific resistance of $10^{10}$ Ω·cm or more.

The fourteenth aspect of the present invention is the electrophotographic photoconductor according to the thirteenth aspect, wherein the metal oxide is at least one selected from the group consisting of alumina, titanium oxide and silica each having a specific resistance of $10^{10}$ Ω·cm or more.

The fifteenth aspect of the present invention is the electrophotographic photoconductor according to the fourteenth aspect, wherein the metal oxide is α-alumina having a specific resistance of $10^{10}$ Ω·cm or more.

The sixteenth aspect of the present invention is the electrophotographic photoconductor according to the twelfth aspect, wherein the surface protective layer comprises a polymeric charge transport material.

The seventeenth aspect of the present invention is the electrophotographic photoconductor according to the first aspect, wherein the electroconductive substrate has an anodic oxidation coating on the surface thereof.

The eighteenth aspect of the present invention is the electrophotographic photoconductor according to the first aspect, wherein the halogen-free solvent is at least one of cyclic ethers and aromatic hydrocarbons.

The nineteenth aspect of the present invention is a process for manufacturing the electrophotographic photoconductor of the first aspect, comprising the step of applying a coating solution of a charge transport layer so as to form the charge transport layer above a charge generation layer, wherein the coating solution comprises a charge transport material and a halogen-free solvent which is at least one of cyclic ethers and aromatic hydrocarbons.

The twentieth aspect of the present invention is an image forming apparatus which comprises an image forming unit. The image forming unit comprises an electrophotographic photoconductor; a charging unit configured to charge the electrophotographic photoconductor; a light-irradiating unit configured to irradiate the charged electrophotographic photoconductor with imagewise light so as to form a latent electrostatic image on the electrophotographic photoconductor; a developing unit configured to develop the latent electrostatic image with a toner housed therein so as to form a toner image; and a transferring unit configured to transfer the toner image to a recording material, wherein the electrophotographic photoconductor comprises: an electroconductive substrate; a charge generation layer; and a charge transport layer formed by using a halogen-free solvent, arranged in this order. The charge generation layer comprises: a charge generation material in the form of particles having an average particle diameter smaller than a surface roughness of a plane where the electroconductive substrate is arranged; and a polyvinyl acetal resin having a ratio Mw/Mn of a weight-average molecular weight Mw to a number-average molecular weight Mn is 2.2 or more.

The twenty-first aspect of the present invention is the image forming apparatus according to the twentieth aspect, wherein the image forming apparatus comprises a plurality of the image forming unit.

The twenty-second aspect of the present invention is the image forming apparatus according to the twentieth aspect, wherein the light-irradiating unit is one of a light emitting diode and a semiconductor laser system.

The twenty-third aspect of the present invention is the image forming apparatus according to the twentieth aspect, wherein the charging unit is a contact charging unit.

The twenty-fourth aspect of the present invention is the image forming apparatus according to the twentieth aspect, wherein the charging unit is a non-contact charging unit.

The twenty-fifth aspect of the present invention is the image forming apparatus according to the twenty-fourth aspect, wherein the charging unit comprises a charger in which the charger is disposed so as to form a gap between the charger and electrophotographic photoconductor being 200 μm or less.

The twenty-sixth aspect of the present invention is the image forming apparatus according to the twentieth aspect, wherein the charging unit is so configured as to apply a voltage superimposed with an alternating voltage.

The twenty-seventh aspect of the present invention is a photoconductor which comprises an electrophotographic photoconductor, and at least one of: a charging unit configured to charge the electrophotographic photoconductor; a developing unit configured to develop a latent electrostatic image formed on the electrophotographic photoconductor with a toner so as to form a toner image; a transferring unit configured to transfer the toner image to a recording material; and a cleaning unit configured to remove the residual toner on the electrophotographic photoconductor after transferring the toner image, wherein the process cartridge is detachably assembled to a main body of image forming apparatus. The electrophotographic photoconductor comprising: an electroconductive substrate; a charge generation layer; and a charge transport layer formed by using a halogen-free solvent, arranged in this order, wherein the charge generation layer comprises: a charge generation material in the form of particles having an average particle diameter smaller than a surface roughness of a plane where the electroconductive substrate is arranged; and a polyvinyl acetal resin having a ratio Mw/Mn of a weight-average molecular weight Mw to a number-average molecular weight Mn is 2.2 or more.

Further objects, features and advantages of the present invention will become apparent from the following description of the preferred embodiments with reference to the attached drawings.

DESCRIPTION OF THE PREFERRED EMBODIMENTS

Figure 1:
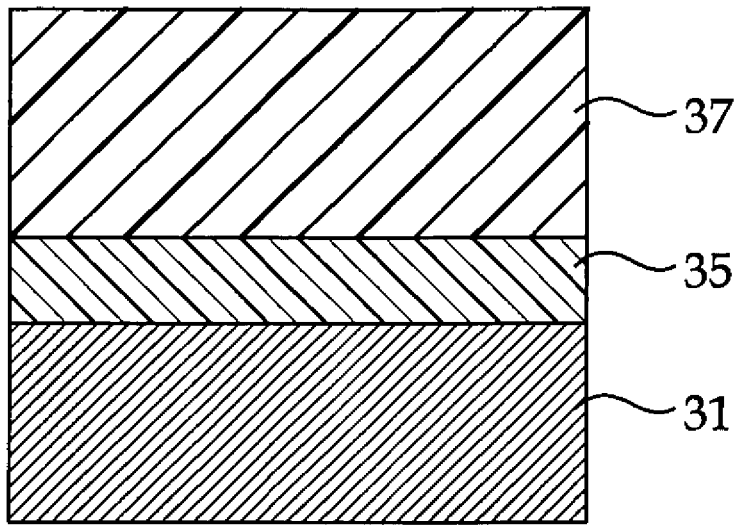
FIG. 1 is a schematic sectional view of an example of the electrophotographic photoconductor according to the present invention.

The present invention will be illustrated in detail below. Examples of the halogen-free solvent for use in the charge transport layer of the present invention are cyclohexanone, tetrahydrofuran, dioxolane, dioxane, toluene, xylene, ethyl ether, acetone, ethanol, methyl ethyl ketone, dimethylformamide, ethylene glycol, dimethyl ether and anisole. Among them, cyclic ethers such as tetrahydrofuran, dioxolane and dioxane; aromatic hydrocarbons such as toluene and xylene, and derivatives of them are preferred.

The "surface roughness" as used herein means a ten-point-average height. More specifically, the ten-point-average height is defined as the difference between the average height of five peaks and the average height of five bottoms in a reference length according to Japanese Industrial Standards (JIS) B 0601. The ten-point-average height can be determined, for example, using a surface texture and contour measuring instrument SURFCOM 1400A (trade name, available from Tokyo Seimitsu Co., Ltd.).

Examples of charge generation materials for use in the present invention are azo pigments typically having a carbazole skeleton, triphenylamine skeleton, diphenylamine skeleton, dibenzothiophene skeleton, fluorenone skeleton, oxadiazole skeleton, bisstilbene skeleton, distyryloxadiazole skeleton or distyrylcarbazole skeleton; metallophthalocyanines, non-metallo-phthalocyanines and other phthalocyanine pigments; azulenium salt pigments; methine squarate pigments; perylene pigments; anthraquinone or polycyclic quinone pigments; quinoneimine pigments; diphenylmethane and triphenylmethane pigments; benzoquinone and naphthoquinone pigments; cyanine and azomethine pigments; indigoid pigments; bisbenzimidazole pigments; and other organic pigments. Each of these organic pigments can be used alone or in combination. Among them, titanyl phthalocyanine (TiOPc) pigments represented by following Formula (1) having titanium as a central metal have higher sensitivity and outstanding properties and are preferred.

(1)

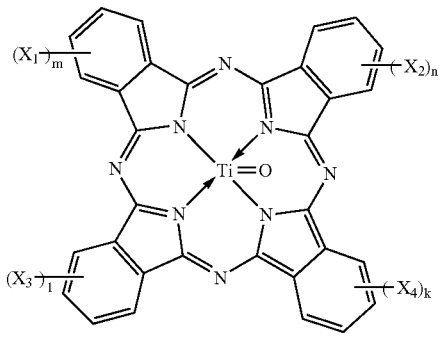

In Formula (1), $X_1$, $X_2$, $X_3$ and $X_4$ are each independently a halogen atom; and n, m, l and k are each independently an integer of 0 to 4.

Production methods and electrophotographic properties of the titanyl phthalocyanine can be found typically in JP-A Nos. 57-148745, 59-36254, 59-44054, 59-31965, 61-239248 and 62-67094. A variety of crystal systems of titanyl phthalocyanine are known as disclosed typically in JP-A Nos. 59-49544, 59-416959, 61-239248, 62-67094, 63-366, 63-116158, 63-196067, 64-17066, and 2001-19871.

Among these titanyl phthalocyanines, a titanyl phthalocyanine showing a maximum diffraction peak at 27.2° in terms of Bragg 2θ angle is preferred for its specifically excellent sensitivity. In particular, the titanyl phthalocyanine disclosed in JP-A No. 2001-19871 is preferred. This titanyl phthalocyanine shows a maximum diffraction peak at 27.2°, major peaks at 9.4°, 9.6° and 24.0° and a diffraction peak as a lowest-angle peak at 7.3° and having no peak in a range between 7.4° and 9.4° in terms of Bragg 2θ angle to the CuK-α characteristic X-ray wavelength at 0.1542 nm. This titanyl phthalocyanine can yield an electrophotographic photoconductor showing stable and excellent electrostatic properties even after repetitive use. Among the crystalline systems, one showing no peak at 26.3° can provide further significant advantages of the present invention.

A method for producing a crude titanyl phthalocyanine without using a titanium halide as a raw material can be found in JP-A No. 06-293769. The most advantage of the method is that the resulting crude titanyl phthalocyanine is free from halogen. If a titanyl phthalocyanine includes a halogenated titanyl phthalocyanine as an impurity, the resulting photoconductor often shows deteriorated electrostatic properties such as decreased optical sensitivity and/or decreased charge ability (Japan Hardcopy '89, Manuscripts p. 103 (1989)). The present invention is mainly intended to and effectively uses halogen-free titanyl phthalocyanines as described in JP-A No. 2001-19871.

This technique can be clearly distinguished in configuration and advantages from a technique using a halogenated titanyl phthalocyanine as mentioned in JP-A No. 2001-115054.

Suitable examples of binder resins for use in the charge generation layer are polyvinyl formal, polyvinyl butyral and other polyvinyl acetal having a ratio Mw/Mn of a weight-average molecular weight Mw to a number-average molecular weight Mn is 2.2 or more. Among them, polyvinyl acetal resins having a number-average molecular weight Mn in terms of polystyrene of 100,000 or more are more preferred.

Such polyvinyl acetal has different properties depending on the degree of polymerization, ratios of hydroxyl group and acetyl group, and degree of acetalization. Among them, those having a structure of the following formula and having a degree of polymerization of 500 to 5,000 and a content of hydroxyl group of 25% by mole to 40% by mole are preferred for better properties, of which those having a degree of polymerization of 1,000 to 3,000 and a content of hydroxyl group of 30% by mole to 36% bye are more preferred.

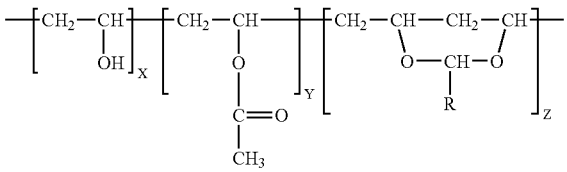

In the above formula, X, Y and Z are each a compositional ratio and satisfy the following conditions: $X+Y+Z=1$; $0.25 \leqq X \leqq 0.40$; $0 \leqq Y \leqq 0.1$; $0.60 \leqq Z \leqq 0.75$; and R is a hydrogen atom or an alkyl group.

In the present invention, the average particle diameter of the charge generation material can be determined by applying a dispersion of the material to form a film, and observing the film with an electron microscope. The charge generation material can have any form such as riziform or needle-form. Upon direct observation, the average particle diameter can be determined by measuring the length in the longitudinal direction of at least ten particles and calculating an arithmetic average therefrom.

The electrophotographic photoconductor of the present invention has a satisfactory initial sensitivity, keeps its high sensitivity even after repetitive use and has outstanding electrostatic properties even when a halogen-free solvent is used in the coating composition for charge transport layer. The reasons of these advantages are not clarified, but are supposed as follows.

The charge generation layer mainly comprises the charge generation material and a resin, and particles of the charge generation material are surrounded by the resin (sometimes, the resin is adsorbed by the particles). Thus, the particles of the charge generation material are prevented from coming into contact and aggregating with each other. When the coating composition for charge transport layer is applied, the resin changes its surface energy by action of the solvent in the coating composition and has significantly decreased adhesive force with respect to an under layer, i.e., an electroconductive substrate or an interlayer. Thus, the particles of charge generation material are removed from the electroconductive substrate or interlayer and aggregate with each other. The cause is not clarified but the particles significantly aggregate upon the use of a halogen-free solvent. Such halogen-free solvent has therefore been believed unsuitable. Likewise, particles of a charge generation material having a small particle diameter often aggregate. This is probably because the adsorbed resin has an increased specific surface area to cause significant change of the surface energy, thus inviting aggregation.

When the charge generation material aggregates in the charge generation layer, the resulting layer shows two disadvantages in photocarrier generation. One is a decreased efficiency of photocarrier generation. More specifically, upon aggregation, the distance between the core (central part) of the particles of charge generation material as a carrier generation site and the surface of the particles as a carrier injection site (a site at which a charge is transferred from the charge generation material to a charge transport material) increases. Thus, most of photocarriers generated in the core of the particles of charge generation material may possibly be deactivated before reaching the carrier injection site on the surface of the particles. The other disadvantage is a decreased efficiency of photocarrier injection. Specifically, such aggregated particles become coarse and have a decreased surface area. The contact area with the charge transport material surrounding the surface of the particles of charge generation material decreases, thus decreasing the injection efficiency. In any case, the aggregation adversely affects the overall photocarrier generation, thus inviting decreased optical sensitivity and/or increased residual potential.

According to the present invention, the aggregation problem of the charge generation material can be reduced by setting the average particle diameter of the charge generation material particles smaller than the surface roughness of the plane where the charge generation layer is arranged, such as lower layer. Specifically, the plane where the charge generation layer is the surface of the electroconductive substrate or interlayer. This is probably because such charge generation material particles having a smaller average particle diameter in depressions of the lower layer (electroconductive substrate or interlayer) hardly move over the depressions toward surroundings. More specifically, the movement of the particles to aggregate can be prevented by setting the average particle diameter of the charge generation material for use in the charge generation layer smaller than the surface roughness of the lower layer.

The aggregation can also be reduced by incorporating a polyvinyl acetal having a ratio of the weight-average molecular weight Mw to the number-average molecular weight Mn of 2.2 or more into the charge generation layer. This is probably as follows. The molecular weight of a resin significantly affects the adhesive force between the charge generation layer and the lower layer (electroconductive substrate or interlayer). More specifically, the combination use of a resin having a high molecular weight and having good electric properties, and configuration with such a polyvinyl acetal resin having a wide molecular weight distribution and containing a low-molecular weight component with good adhesiveness can produce a high-sensitivity photoconductor without aggregation.

By setting the average particle diameter of the charge generation material at 0.3 μm or less and using a polyvinyl acetal resin having a number-average molecular weight Mn of 100,000 or more in the charge generation layer, the charge generation material in the resulting electrophotographic photoconductor can keep an average particle diameter of 0.3 μm without aggregation, and the electrophotographic photoconductor can have a significantly high sensitivity without deterioration even after repetitive use. For more stable dispersion and more stable crystallinity, the average particle diameter of the charge generation material is preferably from 0.05 μm to 0.2 μm.

Photoconductors prepared by laminating a charge transport layer using a halogen-free solvent show outstanding electrostatic properties to thereby prevent image failure such as background fog. This is probably because such photoconductors are not affected by chlorine or other halogen ions contained in a halogen-containing solvent.

Thus, electrophotographic photoconductors having a high initial sensitivity, keeping its high sensitivity even after repetitive use and showing good electrostatic properties can be obtained by specifying the average particle diameter of the charge generation material, the surface roughness of the electroconductive substrate or interlayer and using a specific binder resin in the charge generation layer.

To prepare the electrophotographic photoconductors of the present invention, it is effective to roughen a plane on which the charge generation layer is arranged. The plane may be roughened, for example, by subjecting the surface of the electroconductive substrate to continuous cutting using a cutting tool, by subjecting the same to hydro-honing, superfinishing or wet or dry blasting or by forming an anodic oxidation coating thereon. If the plane is not sufficiently roughed, the advantages of the present invention may not be obtained, but an excessively roughened surface may adversely affect the formation of the charge generation layer. The surface roughness of the electroconductive substrate is preferably from 0.1 μm to 2 μm and more preferably from 0.3 μm to 1.5 μm.

An interlayer arranged between the electroconductive substrate and the charge generation layer is effective for improving the adhesion and coating ability of the charge generation layer and electrostatic properties of the electrophotographic photoconductor. The interlayer is more preferably a pigment-dispersed layer in which an inorganic pigment, preferably a white pigment, is dispersed. This type of interlayer scatters incoming light to thereby prevent interference fringe. An interlayer having a large thickness may have a smoothed surface. In this case, the surface of the interlayer is effectively roughened by applying artificial force when the interlayer is coated. More specifically, the surface of the interlayer can be roughened by dipping the electroconductive substrate to a coating composition for interlayer, and lifting up the electroconductive substrate from the coating composition while vibrating the liquid surface of the coating composition. The liquid surface of the coating composition may be vibrated typically by using an ultrasonic generator or stirrer.

The surface of the interlayer can also be roughened by vibrating the electroconductive substrate using a motor during the coating procedure or blowing air immediately after applying the coating composition for interlayer.

The surface of the interlayer may also be roughened by forming a Benard cell structure on the applied coating of the interlayer. The Benard cell structure is a rough surface structure of a coating film, called as "orange peel". When a thin film is formed on a coating layer having a Benard cell structure, the upper thin film may not be satisfactorily formed with good quality. Thus, in regular coating procedures, the formation of the Benard cell structure is prevented. However, the present invention positively uses the features of the Benard cell structure. In the formation of Benard cells, a convection current (Benard current) occurs due to differences in physical properties between the core of a wet coating film and the surface thereof to thereby form a geometric pattern on the surface of the dried coating film. Conditions for inducing the convection current to form Benard cells are as follows:

(1) a large evaporation rate of a solvent in the coating composition for the coating film;
(2) a wide particle size distribution of particles dispersed in the coating composition;
(3) a large thickness of a wet coated film;
(4) a low viscosity of the coated film;
(5) a great surface tension of the coated film;
(6) a low concentration of vapor of the solvent in the coating atmosphere; and
(7) a high temperature of the coating atmosphere.

Under these conditions, an interlayer having a desired surface roughness can be easily and effectively prepared.

As in the electroconductive substrate, the roughening of the surface of interlayer is also effective in the present invention. However, an excessively roughened surface may adversely affect the formation of the charge generation layer, and the surface roughness of the interlayer is preferably from 0.1 μm to 2 μm, and more preferably from 0.3 μm to 1.5 μm.

The charge generation layer according to the present invention should contain a polyvinyl acetal resin having a ratio of a weight-average molecular weight Mw to a number-average molecular weight Mn of 2.2 or more, preferably 2.6 or more, as determined by molecular weight distribution measured by gel permeation chromatography (GPC). The polyvinyl acetal resin preferably has a number-average molecular weight Mn in terms of polystyrene of 100,000 or more for better film forming properties and electric properties. The molecular weight distribution is not necessarily a normal distribution and may have plural molecular weight peaks.

The electrophotographic photoconductor according to the present invention will be illustrated in detail with reference to the drawings.

FIG. 1 is a schematic sectional view of an example of the electrophotographic photoconductor according to the present invention. The electrophotographic photoconductor comprises an electroconductive substrate 31, and on or above the electroconductive substrate 31 are sequentially arranged a charge generation layer 35 mainly comprising a charge generation material, and a charge transport layer 37 mainly comprising a charge transport material.

Figure 2:
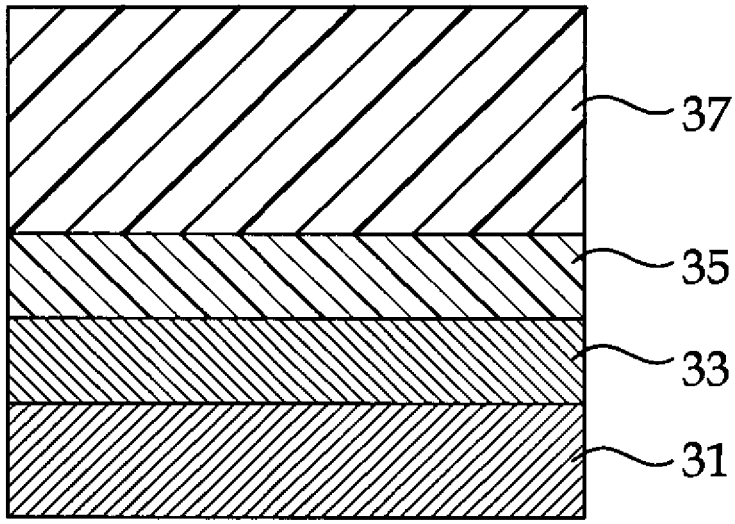
FIG. 2 is a schematic sectional view of another example of the electrophotographic photoconductor.

FIG. 2 is a schematic sectional view of another example of the electrophotographic photoconductor. The electrophotographic photoconductor comprises an electroconductive substrate 31, an interlayer 33, a charge generation layer 35 mainly comprising a charge generation material, and a charge transport layer 37 mainly comprising a charge transport material, sequentially arranged in this order.

The electroconductive substrate 31 may be a film-shaped or cylindrically-shaped plastic or paper covered with a conducting material having a volume resistivity of $10^{10}$ Ω·cm, e.g., a metal such as aluminum, nickel, chromium, nichrome, copper, gold, silver or platinum, or a metal oxide such as tin oxide or indium oxide, by vapor deposition or sputtering, or it may be a plate of aluminum, aluminum alloy, nickel or stainless steel, and this may be formed into a tube by extrusion or drawing. The endless nickel belt and endless stainless steel belt disclosed in JP-A No. 52-36016 can also be used as the electroconductive substrate 31.

The electrophotographic photoconductor may further comprise an interlayer between the electroconductive substrate 31 and the charge generation layer 35. The interlayer generally comprises a resin, but limited thereto. The resin herein preferably has a high resistance to general organic media or solvents, since the coating composition for charge generation layer to be formed on the interlayer contains an organic solvent. Such resins having high solvent resistance include, for example, polyvinyl alcohol, casein, polysodium acrylate and other water-soluble resins; copolyamides, methoxymethylated polyamides, and other alcohol-soluble resins; polyurethanes, melamine resins, phenol resins, alkyd-melamine resins, epoxy resins and other curable resins having a three-dimensional network structure. The interlayer may further comprise a finely-powdered pigment of a metal oxide such as titanium oxide, silica, alumina, zirconium oxide, tin oxide and indium oxide for preventing interference fringe and reducing residual potential.

The interlayer can be formed by using an appropriate solvent and an appropriate coating procedure as in the photoconductive layer. The interlayer is effectively formed under the application of mechanical vibration or under such conditions as to form Benard cells to have a roughened surface. A layer of, for example, a silane coupling agent, titanium coupling agent or chromium coupling agent can also be used as the interlayer. An anodic oxidation film of $Al_2O_3$ or a thin film prepared by a vacuum process and comprising an organic substance such as a poly-p-xylylene (parylene) or an inorganic substance such as $SiO_2$, $SnO_2$, $TiO_2$, ITO or $CeO_2$ can also be used as the interlayer. In short, any of conventional interlayers can be used in the present invention. The interlayer preferably has a thickness of 0 to 5 μm.

Next, the photoconductive layer will be illustrated in detail. The photoconductive layer comprises plural layers, i.e., the charge generation layer 35 and the charge transport layer 37 for better properties in sensitivity and durability.

The charge generation layer 35 comprises the aforementioned organic pigment as a charge generation material. The charge generation layer can be prepared by dispersing the organic pigment and the polyvinyl acetal resin in an appropriate solvent to form a coating composition, applying the coating composition to the electroconductive substrate and drying the resulting coating.

As the solvent used herein, isopropanol, acetone, methyl ethyl ketone, cyclohexanone, tetrahydrofuran, dioxane, ethyl cellosolve, ethyl acetate, methyl acetate, cyclohexane, toluene, xylene, ligroin, and other halogen-free (halogen-free) solvents are preferred. Among them, ketone solvents, ester solvents and ether solvents are particularly preferred.

The components of the coating composition may be dispersed by subjecting the crude powdery pigment in the presence of a disperse solvent to pulverization by pulverization means such as a ball mill, vibration mill, disc vibration mill, attriter, sand mill, paint shaker, jet mill or ultrasonic disperser, in which mechanical energy such as compression, shearing, attrition, friction, elongation, impact or vibration is applied to the pigment.

The present inventors have found that by thoroughly dispersing the organic pigment and the polyvinyl acetal) resin in the disperse solvent, the polyvinyl acetal resin has a decreased molecular weight. To compensate this, a polyvinyl acetal resin having a ratio Mw/Mn of a weight-average molecular weight Mw to a number-average molecular weight Mn of 2.2 or more, preferably 2.6 or more and having a number-average molecular weight Mn in terms of polystyrene of 100,000 or more is preferably used.

The coating solution may be applied by impregnation coating, spray coating, beat coating, nozzle coating, spinner coating or ring coating. The film thickness of the charge generation layer 35 is from 0.01 μm to 5 μm, and preferably from 0.1 μm to 2 μm. The electrophotographic photoconductor of the present invention shows a high sensitivity even in a thickness of 0.2 μm or less and thereby has satisfactory electrostatic properties.

The charge transport layer 37 can be prepared by dissolving or dispersing the charge transport material and binder resin in a halogen-free solvent, applying the resulting coating composition to the charge generation layer and drying the coating. Where necessary, additives such as a plasticizer, leveling agent and antioxidant can be added to the coating composition. The halogen-free solvent herein is preferably at least one of cyclic ethers such as tetrahydrofuran, dioxolane and dioxane, aromatic hydrocarbons such as toluene and xylene, and derivatives thereof.

The charge transport material may be a positive hole transport material or electron transport material. Examples of the electron transport material are electron acceptors such as chloranyl, bromanyl, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide and benzoquinone derivatives.

Examples of positive hole transport substances are poly-N-vinylcarbazole and derivatives thereof, poly-γ-carbazole ethyl glutamate and derivatives thereof, pyrene-formaldehyde condensate and derivatives thereof, polyvinyl pyrene, polyvinyl phenanthrene and polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triaryl methane derivatives, 9-stylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials may be used. These charge transport materials may be used alone, or two or more be mixed and used together.

Examples of the binder resin are thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin and alkyd resin. Among them, polycarbonates are preferred for their outstanding electric properties and abrasion resistance.

The amount of charge transport material is from 20 parts by weight to 300 parts by weight, and preferably from 40 parts by weight to 150 parts by weight relative to 100 parts by weight of the binder resin. The thickness of the charge transport layer is preferably from 5 μm to 100 μm.

A polymer charge transport material having both a function of charge transport material and a function of binder resin, may conveniently be used in the charge transport layer. The charge transport layer which comprises such a polymer charge transport material excels in wear resistance. Although the polymer charge transport material may be a known material. In particular, a polycarbonate having a triarylamine structure in the main chain and/or side chain in the following Formula (2) performs well.

(2)

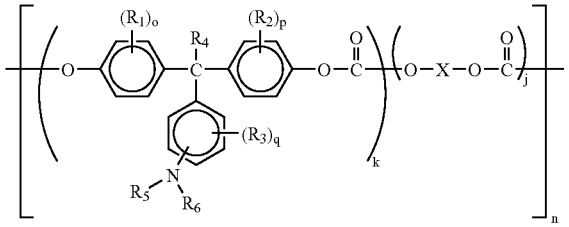

In Formula (2), $R_1$, $R_2$, $R_3$ are respectively substituted or unsubsituted alkyl groups or halogen atoms, $R_4$ is a hydrogen atom or a substituted or unsubsituted alkyl group, $R_5$, $R_6$ are substituted or unsubsituted aryl groups, o, p, q are integers in the range of 0 to 4, k, j represent compositional fractions where $0.1 \leqq k \leqq 1$, $0 \leqq j \leqq 0.9$, n represents the number of repeating units and is an integer in the range of 5 to 5,000. X is an aliphatic divalent group, a cyclic aliphatic divalent group, or the divalent group shown by the following formula:

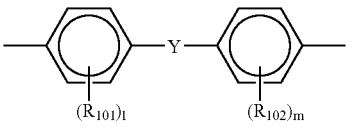

in the above formula, $R_{101}$, $R_{102}$ are respectively substituted or unsubsituted alkyl groups, an aryl group, or a halogen atom, l, m are integers in the range of 0 to 4, Y is a single bond, straight-chain, branched or cyclic alkylene group having 1 to 12 carbon atoms, —O—, —S—, —SO—, —$SO_2$—, —CO—, —CO—O—Z—O—CO— (Z is an aliphatic divalent group), or:

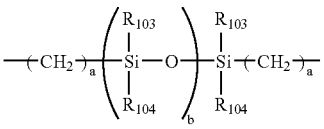

(a is an integer in the range of 1 to 20, b is an integer in the range of 1 to 2,000, $R_{103}$, $R_{104}$ are substituted or unsubstituted alkyl groups or aryl groups). Herein, $R_{101}$, $R_{102}$, $R_{103}$, $R_{104}$ may be respectively identical or different.

(3)

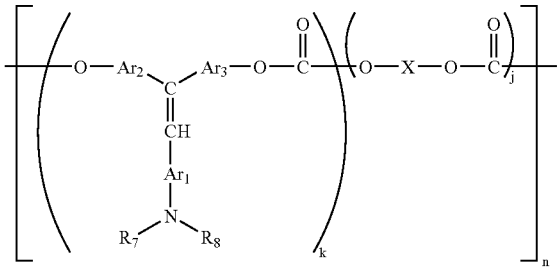

In Formula (3), $R_7$, $R_8$ are substituted or unsubstituted aryl groups, $Ar_1$, $Ar_2$, $Ar_3$ are allylene groups which may be identical or different, X, k, j and n are the same as in Formula (2).

(4)

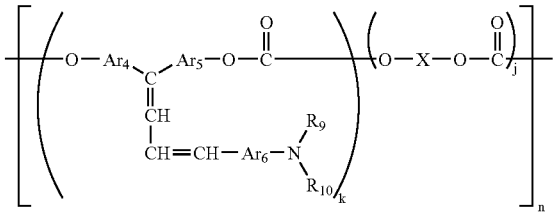

In Formula (4), $R_9$, $R_{10}$ are substituted or unsubstituted aryl groups, $Ar_4$, $Ar_5$, $Ar_6$ are allylene groups which may be identical or different, X, k, j and n are the same as in Formula (2).

(5)

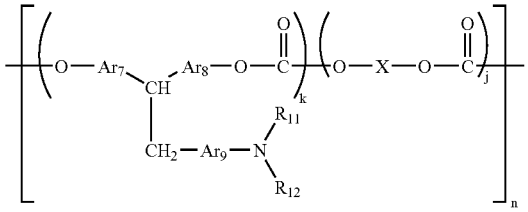

In Formula (5), $R_{11}$, $R_{12}$ are substituted or unsubstituted aryl groups, $Ar_7$, $Ar_8$, $Ar_9$ are allylene groups which may be identical or different, p is an integer in the range of 1 to 5, X, k, j and n are the same as in Formula (2).

(6)

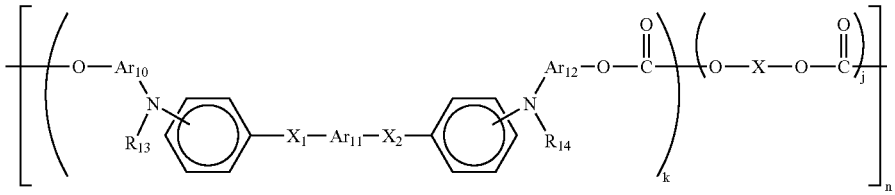

In Formula (6), $R_{13}$, $R_{14}$ are substituted or unsubstituted aryl groups, $Ar_{10}$, $Ar_{11}$, $Ar_{12}$ are allylene groups which may be identical or different, $X_1$, $X_2$ are substituted or unsubstituted ethylene groups, or substituted or unsubstituted vinylene groups. X, k, j and n are the same as in Formula (2).

(7)

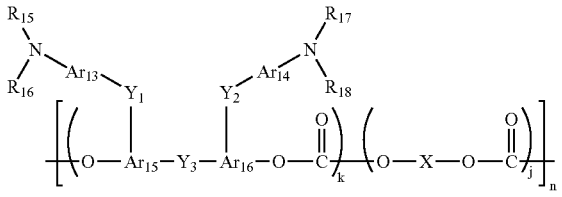

In Formula (7), $R_{15}$, $R_{16}$, $R_{17}$, $R_{18}$ are substituted or unsubstituted aryl groups, $Ar_1$, $Ar_2$, $Ar_3$ are allylene groups which may be identical or different, $Y_1$, $Y_2$, $Y_3$ are single bond, substituted or unsubstituted alkylene groups, substituted or unsubstituted cycloalkylene groups, substituted or unsubstituted alkylene ether groups, oxygen atoms, sulfur atoms or vinylene groups. X, k, j and n are the same as in Formula (2).

(8)

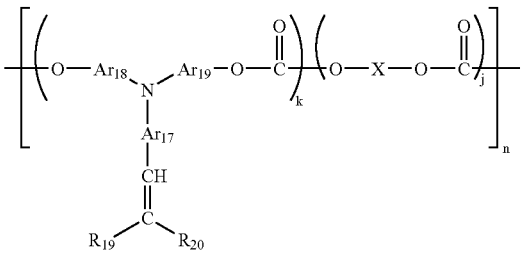

In Formula (8), $R_{19}$, $R_{20}$ are hydrogen atoms, or substituted or unsubstituted aryl groups, and $R_{19}$, $R_{20}$ may form a ring. $Ar_{17}$, $A_{18}$, $A_{19}$ are allylene groups which may be identical or different. X, k, j and n are the same as in Formula (2).

(9)

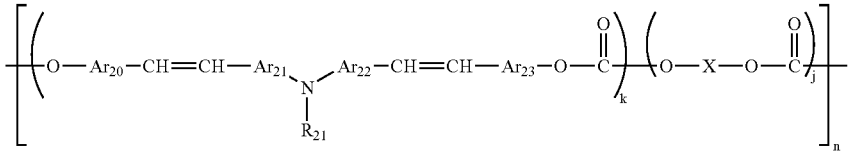

In Formula (9), $R_{21}$ is a substituted or unsubstituted aryl group, $Ar_{20}$, $Ar_{21}$, $Ar_{22}$, $Ar_{23}$ are allylene groups which may be identical or different, X, k, j and n are the same as in Formula (2).

(10)

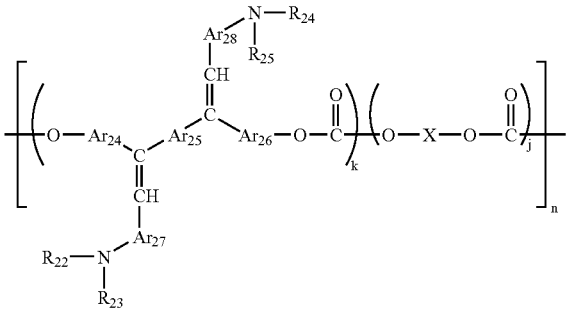

In Formula (10), $R_{22}$, $R_{23}$, $R_{24}$, $R_{25}$ are substituted or unsubstituted aryl groups, $Ar_{24}$, $Ar_{25}$, $Ar_{26}$, $Ar_{27}$, $Ar_{28}$ are allylene groups which may be identical or different. X, k, j and n are the same as in Formula (2).

(11)

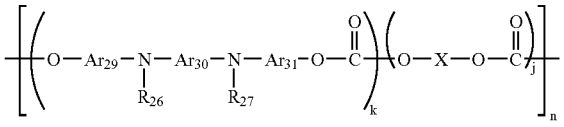

In Formula (11), $R_{26}$, $R_{27}$ are substituted or unsubstituted aryl groups, $Ar_{29}$, $Ar_{30}$, $Ar_{31}$ are allylene groups which may be identical or different. X, k, j and n are the same as in Formula (2).

The polymeric charge transport material for use in the charge transport layer can also be a polymer having a two-dimensional or three-dimensional crosslinking structure. This polymer is prepared by forming a layer of a coating composition containing a monomer or oligomer having an electron donating group and subjecting the formed layer to curing or crosslinking.

Such a charge transport layer comprising the polymer containing an electron donating group or the polymer having a crosslinking structure has excellent abrasion resistance. In an electrophotographic process, the electrostatic potential (potential of an unexposed portion) is generally constant. Thus, if the surface layer of a photoconductor is abraded as a result of repetitive use, an electric field at higher intensity is applied to the electrophotographic photoconductor. With an increasing electric field intensity, the occurrence of background deposition increases. The electrophotographic photoconductor having a high abrasion resistance thereby advantageously prevents background deposition. The charge transport layer comprising such a polymer having an electron donating group can be formed satisfactorily, since the layer itself is a high-molecular-weight compound. It has charge transport sites at higher density and thereby has more excellent charge transport ability than a charge transport layer comprising a polymer containing a dispersed low-molecular weight component. The charge transport layer using the polymeric charge transport material shows satisfactorily rapid response (high-speed responsivity).

Such polymers having an electron donating group also include copolymers, block polymers, graft polymers or star polymers of conventional monomers, as well as crosslinked polymers having an electron donating group as described typically in JP-A Nos. 03-109406, 2000-206723 and 2001-34001.

The charge transport layer 37 may further comprise a plasticizer and/or a leveling agent. Examples of the plasticizer are dibutyl phthalate, dioctyl phthalate, and other plasticizers for resins. The amount of the plasticizer is preferably from 0% by weight to 30% by weight to the binder resin. Examples of the leveling agent are dimethyl silicone oil, methyl phenyl silicone oil and other silicone oils, as well as polymers and oligomers having a perfluoroalkyl group in the side chain thereof. The amount of the leveling agent is preferably from 0% by weight to 1% by weight to the binder resin.

The electrophotographic photoconductor may further comprise a protective layer on the photoconductive layer to thereby protect the photoconductive layer. With an increasing use of computers, demands have been made on high-speed output by printers and on downsized apparatus. The electrophotographic photoconductor of the present invention having a high sensitivity without defects can be more effectively used by arranging a protective layer to thereby increase the durability.

Examples of materials used for the protective layer are resins such as ABS resin, ACS resin, olefine-vinyl monomer copolymer, chlorinated polyether, aryl resin, phenol resin, polyacetal, polyamide, polyamidoimide, polyacrylate, polyallyl sulfone, polybutylene, polybutylene terephthalate, polycarbonate, polyarylate, polyethersulfone, polyethylene, polyethylene terephthalate, polyimide, acrylic resin, polymethylpentene, polypropylene, polyphenylene oxide, polysulfone, polystyrene, AS resin, butadiene-styrene copolymer, polyurethane, polyvinyl chloride, polyvinylidene chloride and epoxy resin, polytetrafluoroethylenes and other fluorocarbon resins, and silicone resins. These resins may contain a dispersed inorganic material such as titanium oxide, aluminum oxide, tin oxide, zinc oxide, zirconium oxide, magnesium oxide, potassium titanate, and surface treated products thereof.

For better high-speed responsivity and reduced residual potential, the protective layer may further comprise a charge transport material. The charge transport material for use in the protective layer includes the charge transport materials and polymeric charge transport materials described in the charge transport layer. The protective layer can be prepared according to a conventional coating procedure. The thickness of the protective layer is preferably from 0.1 μm to 10 μm. In addition, a thin film of amorphous carbon (a-C), amorphous silicon carbide (a-SiC) and other conventional material formed by a vacuum process can also be used as the protective layer.

Next, the image forming apparatus of the present invention will be illustrated in detail with reference to the drawings.

Figure 3:
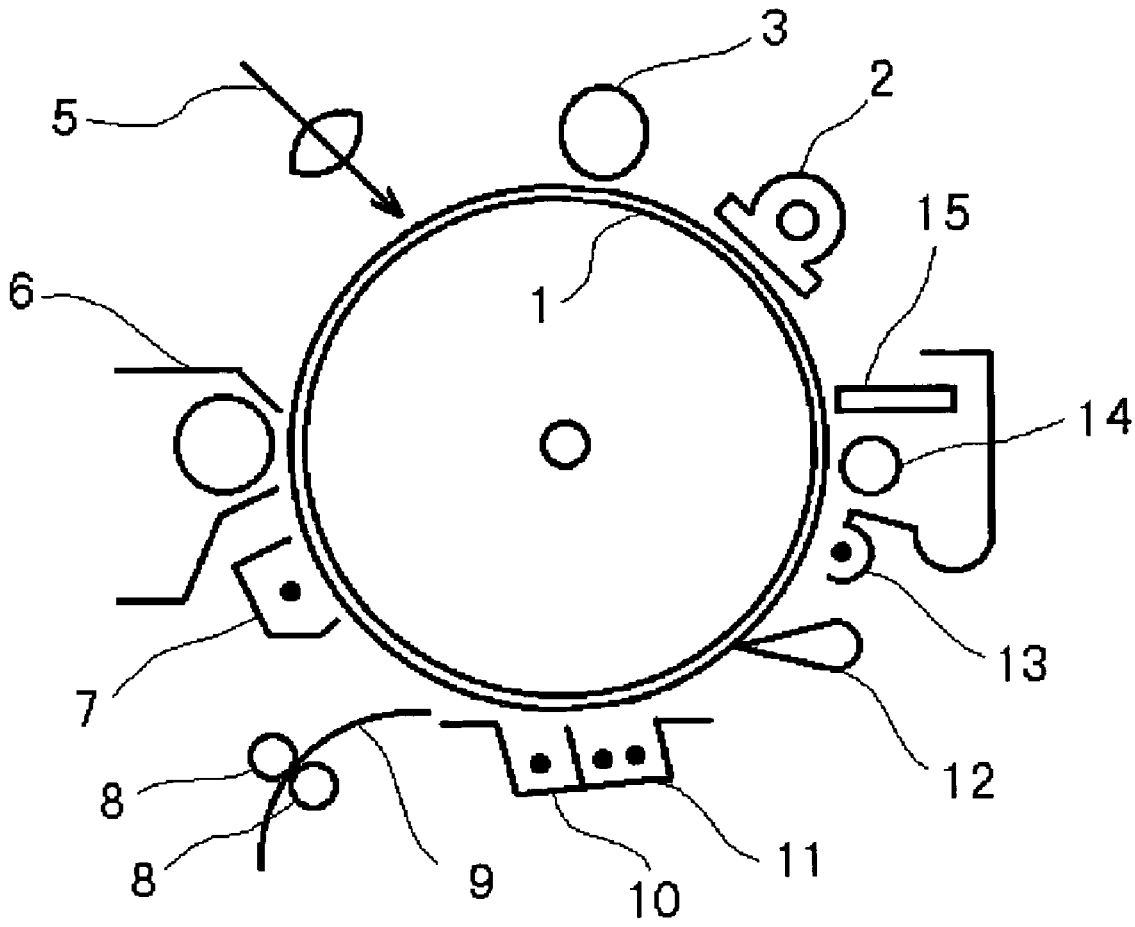
FIG. 3 is a schematic diagram illustrating an example of an image forming apparatus according to the present invention.

FIG. 3 is a schematic diagram illustrating the image forming apparatus of the present invention. However, modifications as mentioned later are also encompassed within the scope of the present invention.

With reference to FIG. 3, a photoreceptor 1 includes a photosensitive layer including at least a charge generation layer and a charge transport layer arranged on or above an electroconductive substrate. The photoreceptor 1 is drum-shaped, and may be sheet-shaped or endless-belt shaped. Any known chargers such as a corotron, a scorotron, a solid state charger, a charging roller and a transfer roller can be used for a charging roller 3 served as a charging unit, a pre-transfer charger 7, a transfer charge 10, a separation charger 11 and a pre-cleaning charger 13.

As the charging system, a contact charging system or non-contact charging system is preferred. The contact charging system has high charge efficiency with less ozone formation and can achieve a downsized apparatus.

The charger of contact charging system, i.e., a contact charging unit, is one wherein the surface of the charger comes into contact with the surface of the electrophotographic photoconductor, and examples are charging rollers, charging blades and charging blushes. Among them, charging rollers and charging blushes are preferably used.

The proximity charger is one wherein the surface of the charger is arranged not in contact with but in the vicinity of the electrophotographic photoconductor surface with a gap of 200 μm or less therebetween. This type of charger can be distinguished from conventional chargers such as a corotron and scorotron in the distance (length) of the gap. The proximity charger for use in the present invention can have any shape, as long as it can appropriately control the gap between the electrophotographic photoconductor surface and the charger surface. For example, the rotation axis of the electrophotographic photoconductor and that of the charger are mechanically fixed so as to have an appropriate gap.

Figure 4:
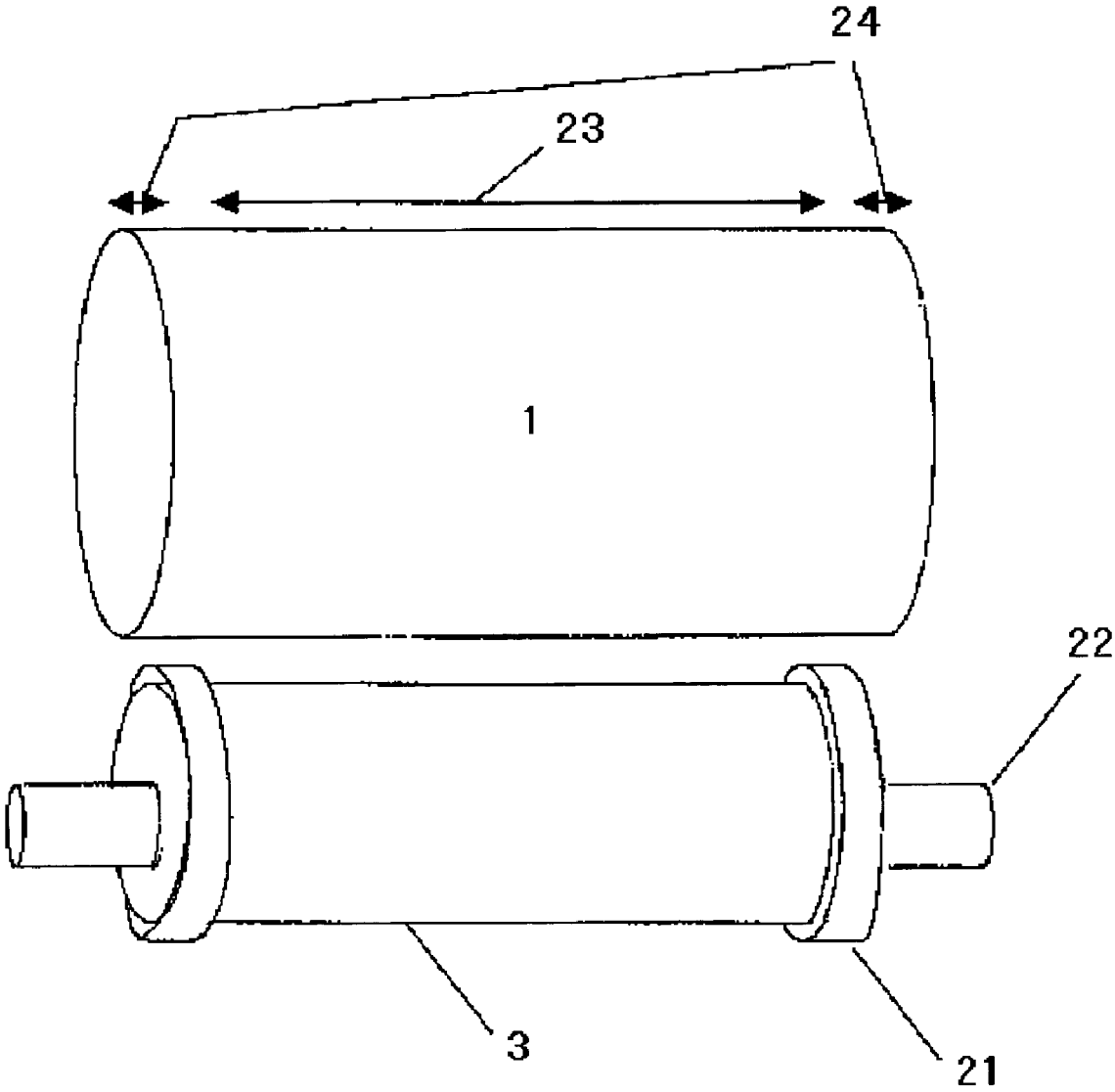
FIG. 4 is a schematic diagram illustrating a proximity charging mechanism in which a gap forming member is placed in the vicinity of a charger.

Preferably, a gap-forming member is arranged at both ends of non-imaging area of a charging roller as the charger, the gap-forming member alone is brought into contact with the electrophotographic photoconductor surface, and the imaging area is held not in contact with the electrophotographic photoconductor surface. Alternatively, a gap-forming member is arranged at both ends of a non-imaging area of the electrophotographic photoconductor, the gap-forming member alone is brought into contact with the charger, and an imaging area is, held not in contact with the charger. These configurations are convenient and can hold the gap stably. Among them, configurations described in Japanese Patent Application Nos. 2001-211448 and 2001-226432 are preferably employed. FIG. 4 illustrates an example of the proximity charging mechanism in which the gap-forming member is arranged on the charger. FIG. 4 shows a gap-forming member 21 and a metal shaft 22 of the charging roller 3, and an imaging area 23 and a non-imaging area 24 on the electrophotographic photoconductor 1.

The above configuration can provide a high charging efficiency with less ozone formation, provide a downsized apparatus and avoid deposition of toner particles and mechanical abrasion by contact and is preferably employed.

As an applied voltage in charging, a voltage including a superimposed alternating voltage on a direct-current voltage is preferably used for avoiding uneven charging.

The light sources served as an image-irradiating unit 5 and charge eliminating lamp 2 may be any light-emitting devices, such as a fluorescent lamp, tungsten lamp, halogen lamp, mercury-vapor lamp, sodium lamp, light emitting diode (LED), semiconductor laser (LD) or electroluminescence (EL).

In order to irradiate only light of a desired wavelength band, various filters such as a sharp cut filter, band pass filter, near-infrared cut-off-filter, dichroic filter, interference filter and color conversion filter, can also be used.

Among these light sources, preferred are light-emitting diodes and semiconductor laser systems which can emit light with high energy and can produce light with long wavelengths of 600 nm to 800 nm, leading to a high sensitivity of the phthalocyanine pigment as the charge generation material.

The light source irradiates the electrophotographic photoconductor with light for providing a transfer step, charge eliminating step cleaning step or pre-exposure and other steps in conjunction with light irradiation, in addition to the steps shown in FIG. 3.

The toner developed on the electrophotographic photoconductor 1 by a developing unit 6 is transferred to the recording paper 9 as a recording material, but not all of it is transferred, and some toner remains on the electrophotographic photoconductor 1. This toner is removed from the electrophotographic photoconductor by a fur brush 14 and blade 15. Cleaning may also be performed only by the cleaning brush, the cleaning brush being any of those known in the art including a fur brush and magnetic fur brush. In FIG. 3, 8 is a resist roller and 12 is a separating tongue.

When the electrophotographic photoconductor is positively (negatively) charged and image exposure is performed, a positive (negative) electrostatic latent image is formed on the electrophotographic photoconductor surface. If this is developed with toner (charge-seeking particulates) of negative (positive) polarity, a positive image will be obtained, and if it is developed with toner of positive (negative) polarity, a negative image will be obtained.

The development unit may be any of those known in the art, and the charge eliminating unit may also be any of those known in the art.

Figure 5:
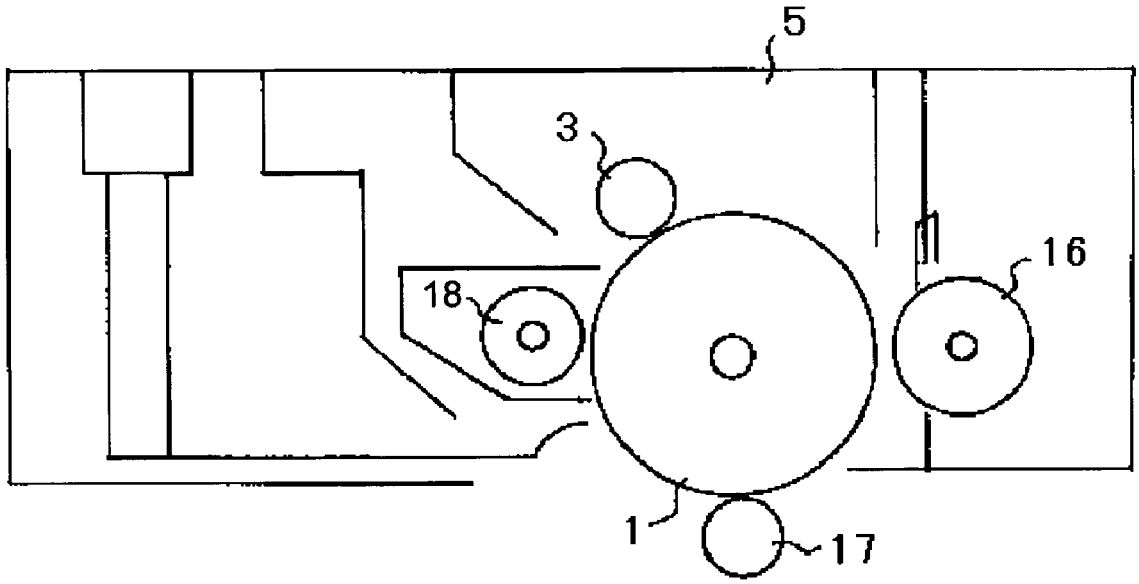
FIG. 5 is a schematic diagram of a process cartridge.

The image-forming unit shown above may be fixed and incorporated in a copier, facsimile or printer, and it may also be incorporated in these devices in the form of a process cartridge. The process cartridge is a device (part) housing a photoconductor and further comprising at least one of other components such as charging unit, light irradiation unit, developing unit, transferring unit, cleaning unit and charge-eliminating unit. The process cartridge may take many forms, but that shown in FIG. 5 is given as a general example. The process cartridge 5 shown in FIG. 5 integrally comprises a photoconductor 1, a charging roller 3 served as a charging unit, a developing roller 16 of developing unit, a transfer roller 17 of transferring unit and a cleaning blush 18 of cleaning unit.

EXAMPLES

Hereafter, the present invention will be described by way of specific examples, but it should be understood that the present invention is not limited in any way thereby. All parts denote parts by weight.

The molecular weight distributions of polyvinyl acetal resins herein were determined by gel permeation chromatography (GPC) under the following conditions.

Determination of Molecular Weight Distribution by GPC

Measuring device: SC-8010 System available from Tosoh Corporation

Column: Shodex KF-800D and KF-805L available from Showa Denko K. K.

Eluent: tetrahydrofuran (THF)

Temperature: 40° C. in column thermostat

Flow rate: 1.0 ml/min

Injection amount: 100 μl

Detector: differential refractive index detector (RI)

Next, a preparation example of the charge generation materials for use in the present invention will be described.

Preparation Example

To a mixture of 29.2 g of 1,3-diiminoisoindoline and 200 ml of sulfolane was added dropwise 20.4 g of titanium tetrabutoxide under a nitrogen gas flow. After the completion of addition, the mixture was gradually raised in temperature to 180° C. and was reacted at a reaction temperature of 170° C. to 180° C. for 5 hours with stirring. After the completion of reaction, the reaction mixture was left stand to cool and was then filtered to yield a precipitate. The precipitate was washed with chloroform until the precipitate colored blue. The cake was then washed with methanol several times, and further washed with hot water of 80° C. several times, followed by drying to yield a crude titanyl phthalocyanine powder. The thus prepared crude titanyl phthalocyanine powder was dissolved in concentrated sulfuric acid having a weight of 20 times the weight of the powder. The solution was added dropwise to iced water having a weight of 100 times the weight of the powder with stirring, to deposit crystals. The crystals were collected by filtration, and the cake was washed with water until the washings became neutral, to yield a wet cake of a titanyl phthalocyanine pigment. Two grams (2 g) of the wet cake was placed into 20 g of tetrahydrofuran, and the mixture was stirred for 4 hours.

Figure 6:
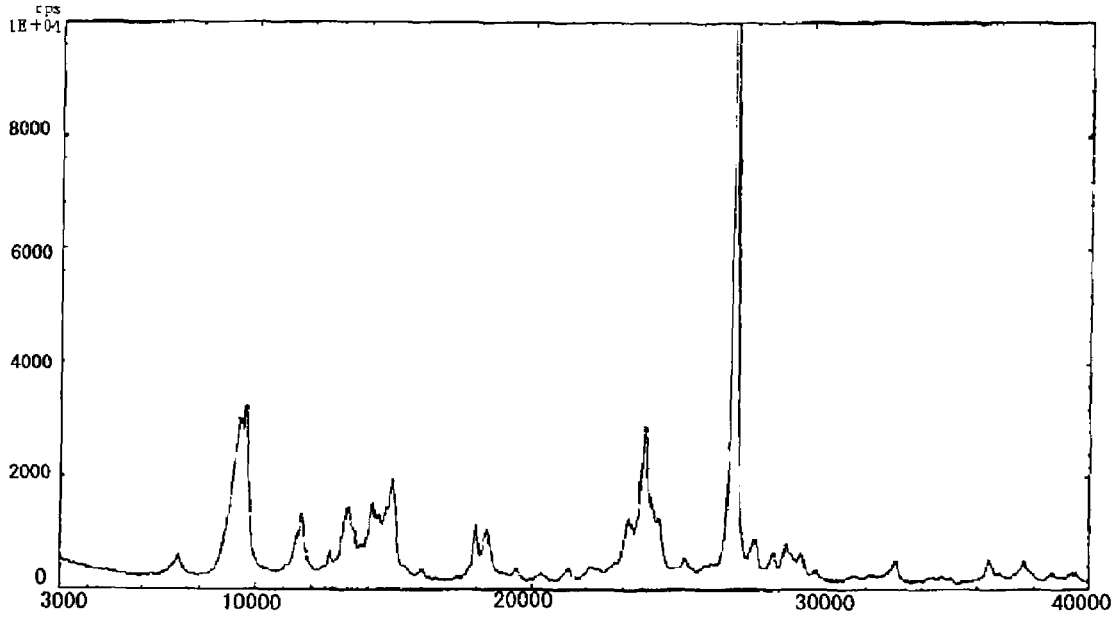
FIG. 6 is an X-ray diffraction spectrum of a powdery titanyl phthalocyanine.

A total of 100 g of methanol was added, the mixture was stirred for 1 hour, was filtrated, was dried and thereby yielded a titanyl phthalocyanine powder according to the present invention. The X-ray diffraction spectrum of the titanyl phthalocyanine powder was determined under the following conditions to find that the titanyl phthalocyanine powder showed a maximum peak at 27.2±0.2° and a peak as a lowest-angle peak at 7.3±0.2° and showed no peak in a range between 7.4° and 9.4° in terms of Bragg (2θ) angles to the CuK-α characteristic X-ray wavelength at 0.1542 nm. The measured X-ray diffraction spectrum is shown in FIG. 6.

Measuring Conditions for X-ray Diffraction Spectrum

| | |
|---|---|
| X-ray tube: | Cu |
| Voltage: | 50 kV |
| Current: | 30 mA |
| Scanning speed: | 2°/min |
| Scanning range: | 3° to 40° |
| Time constant: | 2 seconds |

Example 1

A coating composition for charge generation layer having the following composition was applied to an aluminum base pipe 30 mm in outer diameter and 340 mm in length which had been subjected to cutting and roughening to a surface roughness of 1.0 μm. The coating composition had been subjected to bead-milling and dispersing to an average particle diameter of the pigment of 0.2 μm. The applied film was dried at 80° C. for 20 minutes and thereby yielded a charge generation layer 0.2 μm thick.

| Coating Composition for Charge Generation Layer | |
|---|---|
| Titanyl phthalocyanine pigment prepared in Preparation Example | 15 parts |
| Polyvinyl acetal resin (S-LEC BX-1, Sekisui Chemical Co., Ltd.; Mw/Mn of 3.1, Mn of 120,000) | 7.5 parts |
| Methyl ethyl ketone | 600 parts |

The surface of the prepared charge generation layer was observed with a reflection electron microscope (scanning electron microscope (SEM)), S-4700 (trade name, available from Hitachi High-Technologies Corporation) at a magnification of 50,000 times. Thirty particles of titanyl phthalocyanine on the displayed image having a needle-like shape were arbitrarily selected, and the major axes of them were determined. The measured average particle diameter was 0.2 μm the same as the average particle diameter in the coating composition.

Next, a coating composition for charge transport layer having the following composition was applied to the charge generation layer, was dried at 130° C. for 20 minutes and thereby yielded a charge transport layer having a thickness of 25 μm. Thus, an electrophotographic photoconductor was prepared.

| Coating Composition for Charge Transport Layer | |
|---|---|
| Polycarbonate resin (Iupilon Z200, Mitsubishi Engineering-Plastics Corp.) | 10 parts |
| Charge transport material of following Formula (12) | 8 parts |
| Tetrahydrofuran (THF) | 80 parts |

(12)

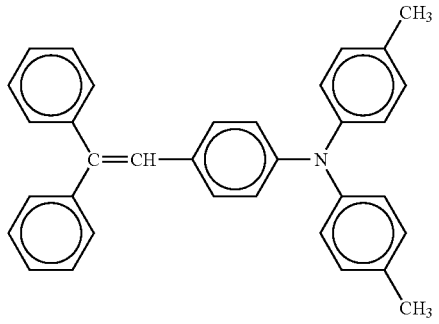

Example 2

A coating composition for interlayer having the following composition was applied to the aluminum base pipe prepared in Example 1 by dipping, was dried at 130° C. for 20 minutes and thereby yielded an interlayer 3 μm thick. The interlayer had a surface roughness of 0.5 μm.

| Coating Composition for Interlayer | |
|---|---|
| Titanium oxide (CR-EL, Ishihara Sangyo Kaisha, Ltd.) | 70 parts |
| Alkyd resin (Beckolite M6401-50-S, solid content 50%, Dainippon Ink and Chemicals, Inc.) | 15 parts |
| Melamine resin (Super Beckamine L-121-60, solid content 60%, Dainippon Ink and Chemicals, Inc.) | 10 parts |
| Methyl ethyl ketone | 100 parts. |

Next, a charge generation layer and a charge transport layer were prepared by the procedure of Example 1 and thereby yielded an electrophotographic photoconductor.

Example 3

An electrophotographic photoconductor was prepared by the procedure of Example 1, except that the aluminum base pipe had been subjected to cutting and roughening so as to have a surface roughness of 0.3 μm.

Comparative Example 1

An electrophotographic photoconductor was prepared by the procedure of Example 1, except that an aluminum base pipe 30 mm in outer diameter and 340 mm in length having a smooth surface with a surface roughness less than 0.05 μm was used without cutting and roughening.

Example 4

A coating composition for interlayer having the composition shown in Example 2 was applied to the aluminum base pipe prepared in Comparative Example 1 by dip coating. During the dip coating, an ultrasonic vibration was applied to the coating composition. The applied film was then dried at 130° C. for 20 minutes and thereby yielded an interlayer 3 μm thick. The interlayer had a surface roughness of 0.8 μm.

Next, a charge generation layer and a charge transport layer were prepared by the procedure of Example 1 and thereby yielded an electrophotographic photoconductor.

Examples 5 and 6 and Comparative Examples 2 to 4

Electrophotographic photoconductors were prepared by the procedures of Examples 1 to 4 and Comparative Example 1, respectively, except for using a coating composition for charge generation layer which had been subjected to bead-milling and dispersing so as to have an average particle diameter of the pigment of 0.6 μm.

Example 7 and Comparative Example 5

The polyvinyl acetal resin (S-LEC BX-1, available from Sekisui Chemical Co., Ltd.) having a ratio Mw/Mn of 3.1 and a number-average molecular weight Mn of 120,000 used in Example 1 was dissolved in methyl ethyl ketone, the solution was subjected to ultrasonic vibration at a frequency of 28 kHz and at 500 W for 1 hour using an ultrasonic cleaner and thereby yielded a polyvinyl acetal resin having a molecular weight distribution of a ratio Mw/Mn of 2.6 and a number-average molecular weight Mn of 10,000, different from the original resin. Electrophotographic photoconductors were then prepared by the procedures of Example 1 and Comparative Example 1, respectively, except for using the above-prepared polyvinyl acetal resin in the coating composition for charge generation layer, as mentioned below.

| Coating Composition for Charge Generation Layer | |
|---|---|
| Titanyl phthalocyanine pigment prepared in Preparation Example | 15 parts |
| Polyvinyl acetal resin (Mw/Mn of 2.6, Mn of 100,000) | 7.5 parts |
| Methyl ethyl ketone | 600 parts |

Example 8

The polyvinyl acetal resin (S-LEC BX-1, available from Sekisui Chemical Co., Ltd.) having a ratio Mw/Mn of 3.1 and a number-average molecular weight Mn of 120,000 used in Example 1 was dissolved in methyl ethyl ketone, the solution was subjected to ultrasonic vibration at a frequency of 28 kHz and at 500 W for 8 hours using an ultrasonic cleaner and thereby yielded a polyvinyl acetal resin having a molecular weight distribution of a ratio Mw/Mn of 2.2 and a number-average molecular weight Mn of 100,000, different from the original resin. Electrophotographic photoconductors were then prepared by the procedures of Example 4, except for using the above-prepared polyvinyl acetal resin in the coating composition for charge generation layer, as mentioned below.

| Coating Composition for Charge Generation Layer | |
|---|---|
| Titanyl phthalocyanine pigment prepared in Preparation Example | 15 parts |
| Polyvinyl acetal resin (Mw/Mn of 2.2, Mn of 100,000) | 7.5 parts |
| Methyl ethyl ketone | 600 parts |

Comparative Example 6

The polyvinyl acetal resin (S-LEC BX-1, available from Sekisui Chemical Co., Ltd.) having a ratio Mw/Mn of 3.1 and a number-average molecular weight Mn of 120,000 used in Example 1 was dissolved in methyl ethyl ketone, the solution was subjected to ultrasonic vibration at a frequency of 28 kHz and at 500 W for 24 hours using an ultrasonic cleaner and thereby yielded a polyvinyl acetal resin having a molecular weight distribution of a ratio Mw/Mn of 1.9 and a number-average molecular weight Mn of 100,000, different from the original resin. Electrophotographic photoconductors were then prepared by the procedures of Example 4, except for using the above-prepared polyvinyl acetal resin in the coating composition for charge generation layer, as mentioned below.

| Coating Composition for Charge Generation Layer | |
|---|---|
| Titanyl phthalocyanine pigment prepared in Preparation Example | 15 parts |
| Polyvinyl acetal resin (Mw/Mn of 1.9, Mn of 100,000) | 7.5 parts |
| Methyl ethyl ketone | 600 parts |

Comparative Example 7

The polyvinyl acetal resin (S-LEC BX-1, available from Sekisui Chemical Co., Ltd.) having a ratio Mw/Mn of 3.1 and a number-average molecular weight Mn of 120,000 used in Example 1 was dissolved in methyl ethyl ketone, the solution was subjected to ultrasonic vibration at a frequency of 28 kHz and at 500 W for 72 hours using an ultrasonic cleaner and thereby yielded a polyvinyl acetal resin having a molecular weight distribution of a ratio Mw/Mn of 1.8 and a number-average molecular weight Mn of 90,000, different from the original resin. Electrophotographic photoconductors were then prepared by the procedures of Example 4, except for using the above-prepared polyvinyl acetal resin in the coating composition for charge generation layer, as mentioned below.

| Coating Composition for Charge Generation Layer | |
|---|---|
| Titanyl phthalocyanine pigment prepared in Preparation Example | 15 parts |
| Polyvinyl acetal resin (Mw/Mn of 1.8, Mn of 90,000) | 7.5 parts |
| Methyl ethyl ketone | 600 parts |

Example 9 and Comparative Example 8

Electrophotographic photoconductors were prepared by the procedures of Example 1 and Comparative Example 1, respectively, except for using dioxane instead of tetrahydrofuran as the solvent in the coating composition for charge transport layer.

Example 10 and Comparative Example 9

Electrophotographic photoconductors were prepared by the procedures of Example 1 and Comparative Example 1, respectively, except for using 50 parts of tetrahydrofuran and 30 parts of toluene instead of 80 parts of tetrahydrofuran as the solvent in the coating composition for charge transport layer.

Comparative Example 10

An electrophotographic photoconductor was prepared by the procedure of Example 1, except for using 80 parts of dichloromethane instead of 80 parts of tetrahydrofuran as the solvent in the coating composition for charge transport layer.

Each of the prepared electrophotographic photoconductors was attached to a process cartridge for image forming apparatus as illustrated in FIG. 5. The process cartridge was attached to a partially modified image forming apparatus (imagio MF-2200, available from Ricoh Company, Limited). The image forming apparatus had been modified so as to use semiconductor laser of 780 nm as an image irradiation unit, and to have a non-contact roller charger as shown in FIG. 4 as a charging unit. The distance (gap) between the electrophotographic photoconductor surface and the charger surface was 100 μm. Printing was then conducted on 100,000 sheets of A4-sized plain paper for copying fed in a longitudinal direction. The resulting image was evaluated on background fog and image density as Good, Fair and Failure. In addition, a surface potential meter was placed on the developer of the image forming apparatus, and the potential after exposure at full emission of the semiconductor laser was determined. The charging conditions are as follows. The results are shown in Table 1.

Charging Conditions

DC bias: −850 V

AC bias: 1.5 kV (peak to peak)

Frequency: 2 kHz

TABLE 1-1

| | Solvent of coating composition for charge transfer layer | Resin in charge generation layer Mw/Mn | Resin in charge generation layer Mn |
|---|---|---|---|
| Example 1 | THF | 3.1 | 120,000 |
| Example 2 | THF | 3.1 | 120,000 |
| Example 3 | THF | 3.1 | 120,000 |
| Example 4 | THF | 3.1 | 120,000 |
| Example 5 | THF | 3.1 | 120,000 |
| Example 6 | THF | 3.1 | 120,000 |
| Example 7 | THF | 2.6 | 100,000 |
| Example 8 | THF | 2.2 | 100,000 |
| Example 9 | dioxolane | 3.1 | 120,000 |
| Example 10 | THF/toluene | 3.1 | 120,000 |
| Comp. Ex. 1 | THF | 3.1 | 120,000 |
| Comp. Ex. 2 | THF | 3.1 | 120,000 |
| Comp. Ex. 3 | THF | 3.1 | 120,000 |
| Comp. Ex. 4 | THF | 3.1 | 120,000 |
| Comp. Ex. 5 | THF | 2.6 | 100,000 |
| Comp. Ex. 6 | THF | 1.9 | 100,000 |
| Comp. Ex. 7 | THF | 1.8 | 90,000 |

TABLE 1-1-continued

| | Solvent of coating composition for charge transfer layer | Resin in charge generation layer Mw/Mn | Resin in charge generation layer Mn |
|---|---|---|---|
| Comp. Ex. 8 | dioxolane | 3.1 | 120,000 |
| Comp. Ex. 9 | THF/toluene | 3.1 | 120,000 |
| Comp. Ex. 10 | dichloromethane | 3.1 | 120,000 |

TABLE 1-2

| | Average particle diameter (μm) | Surface roughness (μm) | Image evaluation Background fog | Image evaluation Image density | VL (−V) |
|---|---|---|---|---|---|
| Example 1 | 0.2 | 1.0 | Good | Good | 90 |
| Example 2 | 0.2 | 0.5 | Good | Good | 110 |
| Example 3 | 0.2 | 0.3 | Fair | Good | 110 |
| Example 4 | 0.2 | 0.8 | Good | Good | 100 |
| Example 5 | 0.6 | 1.0 | Fair | Fair | 135 |
| Example 6 | 0.6 | 0.8 | Fair | Fair | 130 |
| Example 7 | 0.2 | 1.0 | Good | Good | 100 |
| Example 8 | 0.2 | 0.8 | Fair | Good | 120 |
| Example 9 | 0.2 | 1.0 | Good | Good | 105 |
| Example 10 | 0.2 | 1.0 | Good | Good | 95 |
| Comp. Ex. 1 | 0.2 | — | Failure | Failure | 170 |
| Comp. Ex. 2 | 0.6 | 0.5 | Failure | Fair | 145 |
| Comp. Ex. 3 | 0.6 | 0.3 | Failure | Failure | 165 |
| Comp. Ex. 4 | 0.6 | — | Failure | Failure | 170 |
| Comp. Ex. 5 | 0.2 | — | Failure | Failure | 180 |
| Comp. Ex. 6 | 0.2 | 0.8 | Failure | Fair | 150 |
| Comp. Ex. 7 | 0.2 | 0.8 | Failure | Failure | 240 |
| Comp. Ex. 8 | 0.2 | — | Failure | Failure | 190 |
| Comp. Ex. 9 | 0.2 | — | Failure | Failure | 165 |
| Comp. Ex. 10 | 0.2 | 1.0 | Failure | Good | 120 |

Table 1 shows that electrophotographic photoconductors according to Examples 1 to 10 have satisfactory electrostatic properties without deterioration in optical sensitivity.

Example 11

An electrophotographic photoconductor was prepared by the procedure of Example 1, except for using a coating composition for charge transport layer having the following composition.

| Coating Composition for Charge Transport Layer | |
|---|---|
| Polymeric charge transport material of following Formula (13) | 10 parts |
| Silicone oil (KF-50, Shin-Etsu Chemical Co., Ltd.) | 0.001 part |
| Tetrahydrofuran (THF) | 100 parts |

(13)

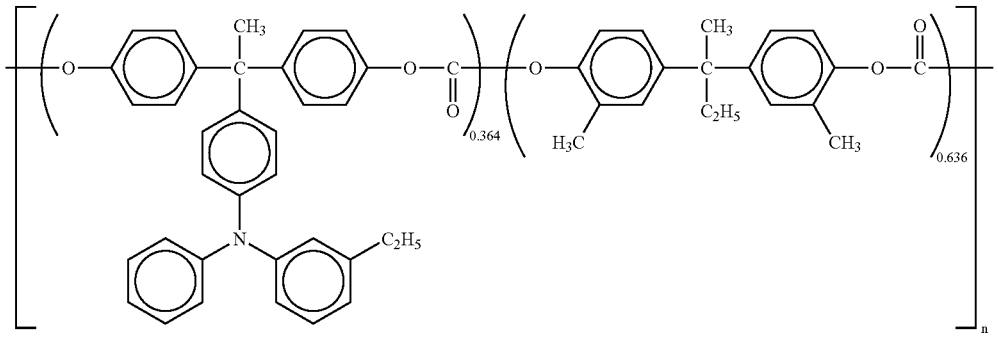

Example 12

An electrophotographic photoconductor was prepared by applying a coating composition for surface protective layer having the following composition to the electrophotographic photoconductor prepared in Example 1, and drying the applied film at 140° C. for 20 minutes to form a surface protective layer having an average thickness of 2 μm.

| Coating Composition for Surface Protective Layer | |
|---|---|
| Polycarbonate resin (Iupilon Z200, Mitsubishi Engineering-Plastics Corp.) | 3.8 parts |
| Charge transport material of Formula (4) | 2.8 parts |
| Alpha-alumina (Sumikorandom AA-04, Sumitomo Chemical Co., Ltd.) | 2.6 parts |
| Cyclohexane | 80 parts |
| Tetrahydrofuran | 280 parts |

Each of the electrophotographic photoconductors prepared in Examples 1, 11 and 12 was attached to a process cartridge for image forming apparatus as illustrated in FIG. 5. The process cartridge was attached to a partially modified image forming apparatus (imagio MF-2200, available from Ricoh Company, Limited). The image forming apparatus had been modified so as to use semiconductor laser of 780 nm as an image irradiation unit, and to have a contact charging roller as the charging unit. Printing was then conducted on 150,000 sheets of A4-sized plain paper for copying fed in a longitudinal direction. The resulting image was evaluated on background fog, image density and abrasion loss. The background fog and image density as image quality were evaluated as Good, Fair and Failure. The results are shown in Table 2.

TABLE 2

| | Surface protective layer | Image evaluation Background fog | Image density | Abrasion loss (μm) |
|---|---|---|---|---|
| Example 1 | no | Fair | Good | 9.2 |
| Example 11 | no | Good | Good | 2.4 |
| Example 12 | yes | Good | Good | 0.2 |

Table 2 shows that the electrophotographic photoconductors according to Examples 11 and 12 have specifically excellent abrasion resistance.

Example 13

Printing on 100,000 sheets was performed and the properties were evaluated by the procedure of Example 1, except-that the distance (gap) between the electrophotographic photoconductor surface and the charger surface in the modified image forming apparatus (imagio MF-2200, available from Ricoh Company, Limited) was set at 50 μm.

Example 14

Printing on 100,000 sheets was performed and the properties were evaluated by the procedure of Example 1, except that the distance (gap) between the electrophotographic photoconductor surface and the charger surface in the modified image forming apparatus (imagio MF-2200, available from Ricoh Company, Limited) was set at 180 μm.

Example 15

Printing on 100,000 sheets was performed and the properties were evaluated by the procedure of Example 1, except that the distance (gap) between the electrophotographic photoconductor surface and the charger surface in the modified image forming apparatus (imagio MF-2200, available from Ricoh Company, Limited) was set at 250 μm.

Example 16

Printing on 100,000 sheets was performed and the properties were evaluated by the procedure of Example 1, except that the distance (gap) between the electrophotographic photoconductor surface and the charger surface in the modified image forming apparatus (imagio MF-2200, available from Ricoh Company, Limited) was set at 100 μm and that charging was performed under the following conditions.

Charging Conditions

DC bias: −850 V

AC bias: none

Thus, similar results were obtained in Examples 13 to 16 as in Example 1. In addition, a halftone image was outputted after printing on 100,000 sheets. According to Examples 1, 13 and 14, a regular normal image was outputted, but according to Examples 15 and 16, a slightly uneven image density due to uneven charging was observed.

Example 17

Printing on 150,000 sheets was performed by the procedure of Example 12, except for using a scorotron charger instead of the contact charging roller as the charger in the image forming apparatus. After the printing on 150,000 sheets, an image was output on 50 sheets at a temperature of 30° C. and relative humidity of 90%.

In the printing on 150,000 sheets, Example 17 showed equivalent results to Example 12, but significant odor of ozone was felt during the printing. The image quality in printing at a temperature of 30° C. and relative humidity of 90% was good and normal in Example 12 but showed slight image blur in Example 17.

As is specifically described in detail above, the present invention provides electrophotographic photoconductors having high initial optical sensitivity, keeping good optical sensitivity even after repetitive use and showing excellent electrostatic properties. The present invention also provides a production method of the electrophotographic photoconductor, as well as an image forming apparatus and process cartridge using the electrophotographic photoconductor.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electrophotographic photoconductor, comprising:

an electroconductive substrate;

a charge generation layer; and a charge transport layer formed by using a halogen-free solvent, arranged in this order, wherein the charge generation layer comprises:

a charge generation material in the form of particles having an average particle diameter smaller than a surface roughness of a plane where the charge generation layer is arranged; and a polyvinyl acetal resin having a ratio Mw/Mn of a weight-average molecular weight Mw to a number-average molecular weight Mn is 2.2 or more;

wherein the charge transport layer comprises polycarbonate having a triarylamine structure in at least one of principal chain and side chain thereof;

wherein the charge generation material is a titanyl phthalocyanine; and wherein the titanyl phthalocyanine shows a maximum diffraction peak at 27.2±0.2° and a peak as a lowest-angle peak at 7.3±0.2° and shows no peak in a range between 7.4° and 9.4° in terms of Bragg 2θ angle to the CuK-α characteristic X-ray wavelength at 0.1542 nm.

2. The electrophotographic photoconductor according to claim 1, wherein the plane where the charge generation layer is arranged is a surface of the electroconductive substrate.

3. The electrophotographic photoconductor according to claim 1, further comprising an interlayer disposed between the electroconductive substrate and the charge generation layer, wherein the plane where the charge generation layer is arranged, is a surface of the interlayer.

4. The electrophotographic photoconductor according to claim 1, wherein the average particle diameter of the charge generation material is 0.3 μm or less and is two-thirds or less of the surface roughness of a plane where the charge generation layer is arranged, and wherein the polyvinyl acetal resin has a number-average molecular weight Mn in terms of polystyrene of 100,000 or more.

5. The electrophotographic photoconductor according to claim 1, wherein the titanyl phthalocyanine shows no peak at 26.3° in terms of Bragg 2θ angle to the CuK-α characteristic X-ray wavelength at 0.1542 nm.

6. The electrophotographic photoconductor according to claim 1, wherein the charge generation layer is formed by a process comprising:

dispersing particles of the titanyl phtalocyanine so as to have an average particle diameter of 0.3 μm or less with a standard deviation of 0.2 μm or less, to yield a dispersion;

filtering the dispersion through a filter having an effective pore size of 3 μm or less; and applying the filtered dispersion to form the charge generation layer.

7. The electrophotographic photoconductor according to claim 1, wherein the titanyl phthalocyanine is prepared by the process comprising:

subjecting an amorphous titanyl phthalocyanine or low-crystallinity titanyl phthalocyanine to crystal transformation using an organic solvent in the presence of water, the amorphous titanyl phthalocyanine or low-crystallinity titanyl phthalocyanine showing a maximum diffraction peak (±0.2) at least at 7.0° to 7.5° with a half width of 1° or more in terms of Bragg 2θ angle to the CuK-α characteristic X-ray wavelength at 0.1542 nm and having an average primary particle diameter of 0.1 μm or less; and fractionating and filtering the crystal-transformed titanyl phthalocyanine from the organic solvent before the transformed crystals of the titanyl phthalocyanine grow to have an average primary particle diameter more than 0.3 μm.

8. The electrophotographic photoconductor according to claim 1, further comprising a surface protective layer on the charge transport layer.

9. The electrophotographic photoconductor according to claim 8, wherein the surface protective layer comprises at least one of an inorganic pigment and a metal oxide each having a specific resistance of $10^{10}$ Ω·cm or more.

10. The electrophotographic photoconductor according to claim 9, wherein the metal oxide is at least one member selected from the group consisting of alumina, titanium oxide and silica, each having a specific resistance of $10^{10}$ Ω·cm or more.

11. The electrophotographic photoconductor according to claim 10, wherein the metal oxide is α-alumina having a specific resistance of $10^{10}$ Ω·cm or more.

12. The electrophotographic photoconductor according to claim 8, wherein the surface protective layer comprises a polymeric charge transport material.

13. The electrophotographic photoconductor according to claim 1, wherein the electroconductive substrate has an anodic oxidation coating on the surface thereof.

14. The electrophotographic photoconductor according to claim 1, wherein the halogen-free solvent is at least one of cyclic ethers and aromatic hydrocarbons.

15. A process for manufacturing a electrophotographic photoconductor, comprising:

applying a coating solution of a charge transport layer so as to form the charge transport layer above a charge generation layer, wherein the coating solution comprises a charge transport material and a halogen-free solvent which is at least one of cyclic ethers and aromatic hydrocarbons, wherein the electrophotographic photoconductor comprises an electroconductive substrate;

the charge generation layer; and the charge transport layer formed by using a halogen-free solvent, arranged in this order, wherein the charge generation layer comprises:

a charge generation material in the form of particles having an average particle diameter smaller than a surface roughness of a plane where the charge generation layer is arranged; and a polyvinyl acetal resin having a ratio Mw/Mn of a weight-average molecular weight Mw to a number-average molecular weight Mn is 2.2 or more;

wherein the charge transport layer comprises polycarbonate having a triarylamine structure in at least one of principal chain and side chain thereof;

wherein the charge generation material is a titanyl phthalocyanine; and wherein the titanyl phthalocyanine shows a maximum diffraction peak at 27.2±0.2° and a peak as a lowest-angle peak at 7.3±0.2° and shows no peak in a range between 7.4° and 9.4° in terms of Bragg 2θ angle to the CuK-α characteristic X-ray wavelength at 0.1542 nm.

16. An image forming apparatus comprising:

an image forming unit which comprises, an electrophotographic photoconductor, a charging unit configured to charge the electrophotographic photoconductor, a light-irradiating unit configured to irradiate the charged electrophotographic photoconductor with imagewise light so as to form a latent electrostatic image on the electrophotographic photoconductor, a developing unit configured to develop the latent electrostatic image with a toner housed therein so as to form a toner image, and a transferring unit configured to transfer the toner image to a recording material, wherein the electrophotographic photoconductor comprises:

an electroconductive substrate;

a charge generation layer; and a charge transport layer formed by using a halogen-free solvent, arranged in this order, wherein the charge generation layer comprises:

a charge generation material in the form of particles having an average particle diameter smaller than a surface roughness of a plane where the electroconductive substrate is arranged; and a polyvinyl acetal resin having a ratio Mw/Mn of a weight-average molecular weight Mw to a number-average molecular weight Mn is 2.2 or more;

wherein the charge transport layer comprises polycarbonate having a triarylamine structure in at least one of principal chain and side chain thereof;

wherein the charge generation material is a titanyl phthalocyanine; and wherein the titanyl phthalocyanine shows a maximum diffraction peak at 27.2±0.2° and a peak as a lowest-angle peak at 7.3±0.2° and shows no peak in a range between 7.4° and 9.4° in terms of Bragg 2θ angle to the CuK-α characteristic X-ray wavelength at 0.1542 nm.

17. The image forming apparatus according to claim 16, wherein the image forming apparatus comprises a plurality of image forming units.

18. The image forming apparatus according to claim 16, wherein the light-irradiating unit is one of a light emitting diode and a semiconductor laser system.

19. The image forming apparatus according to claim 16, wherein the charging unit is a contact charging unit.

20. The image forming apparatus according to claim 16, wherein the charging unit is a non-contact charging unit.

21. The image forming apparatus according to claim 20, wherein the charging unit comprises a charger in which the charger is disposed so as to form a gap between the charger and electrophotographic photoconductor being 200 μm or less.

22. The image forming apparatus according to claim 16, wherein the charging unit is so configured as to apply a voltage superimposed with an alternating voltage.

* * * * *